United States Patent [19]

Wisniewski

[11] 4,262,839

[45] Apr. 21, 1981

[54] MAIL DELIVERY INDICATOR

[76] Inventor: Walter Wisniewski, 5096 N. 325 West, LaPorte, Ind. 46350

[21] Appl. No.: 59,300

[22] Filed: Jul. 20, 1979

[51] Int. Cl.[3] ..... A47G 29/12

[52] U.S. Cl. ..... 232/35

[58] Field of Search ..... 232/35, 34

[56] References Cited

U.S. PATENT DOCUMENTS

| | | | |
|---|---|---|---|
| 686,694 | 11/1901 | Adams | 232/34 |
| 834,122 | 10/1906 | Gordon | 232/34 |
| 918,899 | 4/1909 | Oliver | 232/35 |
| 1,026,338 | 5/1912 | Bailey | 232/35 |
| 2,217,310 | 10/1940 | Fatur | 232/35 |
| 2,808,982 | 10/1957 | Armstrong | 232/35 |
| 2,834,539 | 5/1958 | Carey | 232/35 |
| 3,291,386 | 12/1966 | Van Fleet | 232/35 |
| 3,675,845 | 7/1972 | Scheerer | 232/35 |
| 3,968,928 | 7/1976 | Caldwell | 232/35 |

*Primary Examiner*—Francis K. Zugel

*Attorney, Agent, or Firm*—Marmaduke A. Hobbs

[57] ABSTRACT

A mail delivery indicator in which an arm connected to the door of the mailbox triggers the device when the door is opened so that a banner is raised and prominently displayed to indicate that mail has been delivered. The indicator is reset after the mail has been removed by exerting downward pressure on the banner structure. The indicator can be installed on any conventional mailbox having a door which tips downward when opened. Since the indicator is positioned away from the door of the mailbox, there is little or no danger of a person opening the door being struck when the banner is raised.

6 Claims, 7 Drawing Figures

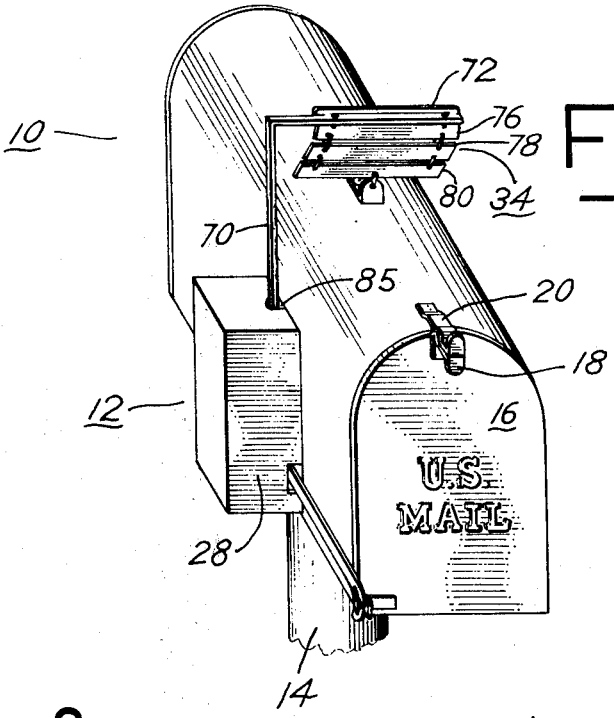
Fig. 1
Fig. 2
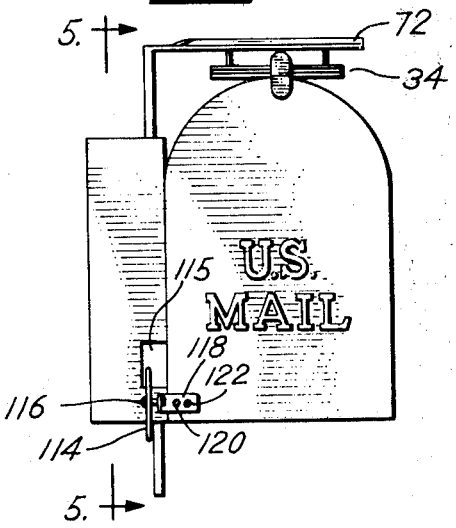
Fig. 3
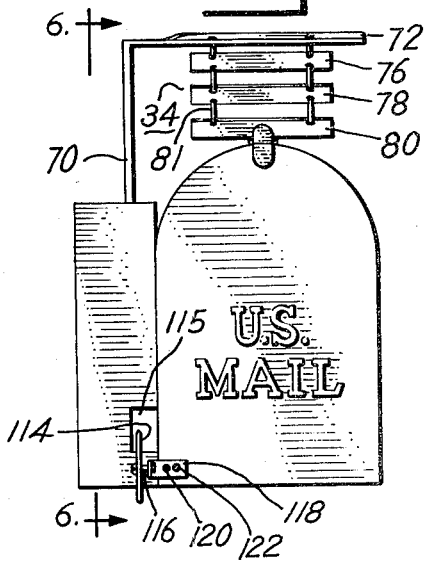
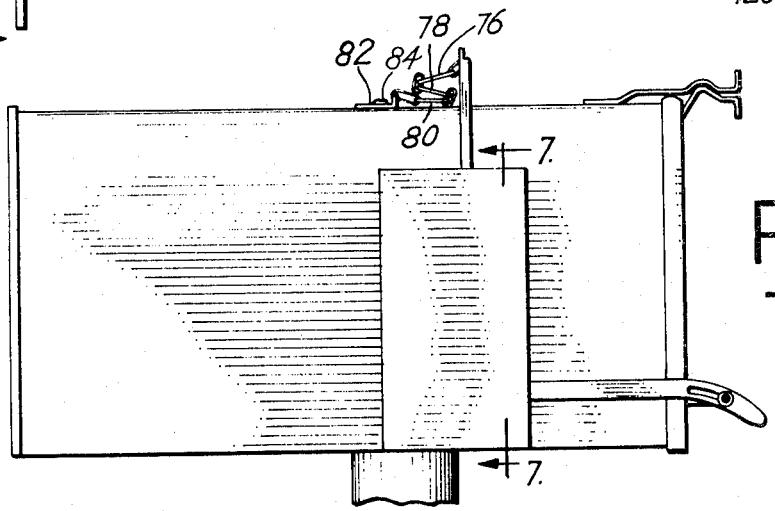
Fig. 4

MAIL DELIVERY INDICATOR

People living in rural areas or in other locations where mail is delivered by motor carrier, are required to provide mailboxes along the road on which the carrier drives. The mail carrier drives to each mailbox and deposits the mail in the box without leaving his vehicle. For many people the location of the mailbox may be a considerable distance from their house or place of business, either at the end of their lane or driveway or, in some circumstances, the mailbox may be grouped with several other mailboxes at a central location. The grouping of mailboxes is commonly done in mobile home trailer parks, subdivisions and the like. In rural areas, the mailbox may be required to be located on the nearest through road so that people living on dead end roads may have their mailbox located a substantial distance from their house. All residences served by motor carriers are required to place their mailbox on one side of the roadway since the mail carrier normally makes only one trip in one direction to deliver the mail. Difficulties arise from this situation, in that the resident cannot be certain when the mail carrier has delivered the mail, especially on delivery routes that do not have dependable times of delivery each day. The person may make several trips to the mailbox, not knowing whether or not the mail has been delivered yet, or whether or not any mail has been delivered to him that day. When the house is a considerable distance from the mailbox, the repeated trips to the mailbox can be most inconvenient, particularly during cold, rain or other inclement weather, when normal delivery times are most unreliable and more trips are likely. Elderly persons and persons having physical handicaps may have difficulty making one necessary trip to the mailbox, and if the mailbox is located on the opposite side of a busy street or highway from the person's house, the repeated trips to the mailbox will not only be inconvenient but will also entail an element of further delay and even danger in crossing the street or highway.

Attempts have been made to solve these difficulties and inconveniences by providing notification flags on the mailboxes which will indicate when the door of the mailbox has been opened, hence indicating that the mail has been delivered. In one such device, a banner is attached to a flexible wire or spring which is mounted on the outside of the mailbox. After removing the mail the resident bends the wire or spring so that the flag is tucked inside the mailbox, and closes the door of the box, thereby securing the flag inside the box. When the door is opened, the spring or wire causes the flag to "pop" out of the box, and the existence of the flag outside the box indicates that the mail has been delivered. Some of the principal difficulties associated with this type of notification device include the possibility of injury to the person opening the door, when the flag "pops" out of the box, if he is standing close to the box or has his hand near the path traveled by the flag. Also, the flag must be held inside the box as the door is closed; hence, it is necessary to use two hands in closing the door. One hand must retain the wire or spring in a position so that the door can be closed with the flag inside the box while the other hand is used to close the door. After having removed the mail from the box, the person usually has only one empty hand, thus making it inconvenient to reset this type of notification device.

It is therefore one of the principal objects of the present invention to provide a mail delivery indicator which will prominently indicate when the mail has been delivered, and which will therefore eliminate the need for repeated trips to the mailbox to ascertain if mail has been delivered.

Another object of the present invention is to provide a mail delivery indicator which is safe and easy to operate, and which can be reset using only one hand, thereby leaving the other hand free to hold the mail removed from the mailbox.

A further object of the present invention is to provide a mail delivery indicator which can be mounted easily and quickly on a conventional mailbox, and which will prominently display a notification element when mail has been delivered, with the notification being visible long distances from the box.

Further objects and advantages of the present invention will be apparent from the following detailed description and accompanying drawings wherein:

FIG. 1 is a perspective view of a mailbox having a mail delivery indicator embodying the present invention installed upon it;

FIG. 2 is an end elevational view of the mailbox and mail delivery indicator, showing the position of the indicator before delivery has been made;

FIG. 3 is an end elevational view of the mailbox and mail delivery indicator, showing the position of the indicator after delivery has been made;

FIG. 4 is a side elevational view of the mailbox and mail delivery indicator;

Figure 5:
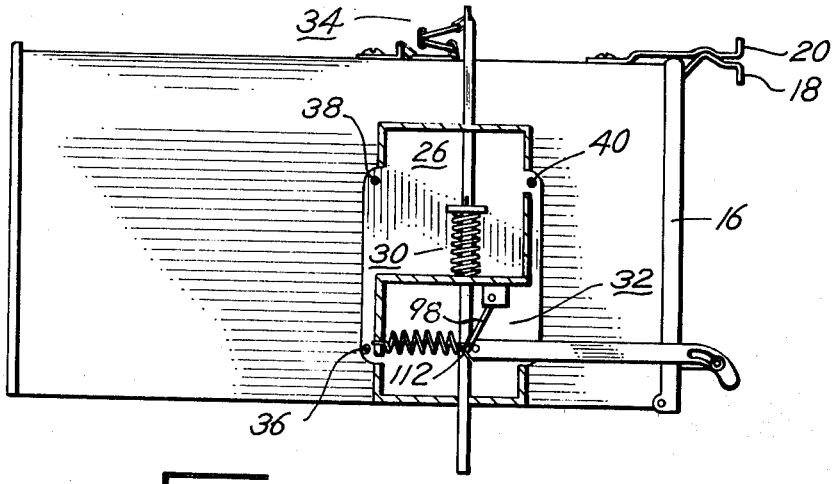
FIG. 5 is a vertical cross sectional view of the mail delivery indicator shown in FIG. 2, the cross section being taken on line 5—5 of the latter figure.

Referring more specifically to the drawings, and to FIG. 1 in particular, numeral 10 designates a mailbox which has a mail delivery indicator 12 embodying the present invention installed on it. The mailbox is attached to a post 14 which is set in the ground along the roadway on which the mail carrier drives. Mailbox 10 is essentially an elongated box-like container having vertical side wall portions, a rounded top, a flat bottom, an enclosed back, a door 16 and a two-part handle and clasp consisting of a lower portion 18 on door 16 and an upper portion 20 extending forward from the enclosed portion of the mailbox. Mailbox 10 is of conventional design and does not constitute a part of the present invention and will not be described more fully herein.

Figure 7:
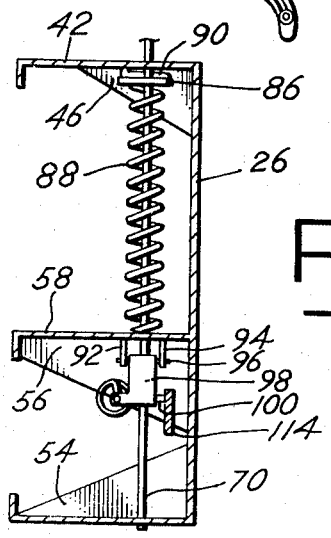
FIG. 7 is an enlarged cross sectional view of the mail delivery indicator shown in FIG. 4, the cross section taken on line 7—7 of FIG. 4.

Delivery indicator 12 consists of a mounting plate 26, a cover 28, an operating or raising mechanism, indicated generally by numeral 30, a trigger or activating mechanism indicated by numeral 32, and a notification banner indicated by numeral 34. As used in the specification and claims, "banner" refers to any type of signal, such as a flag, ball, panel or other object or signal device, exposure of which will indicate mail delivery. Mounting plate 26 is attached to the side wall of mailbox 10 by screws or bolts, three of which indicated by numerals 36, 38 and 40 are shown in the drawings. In the embodiment shown in the drawings, a top 42, bottom 44 and side wall portions 46, 48, 50, 52, 54 and 56 extend outwardly from mounting plate 26. Disposed between side wall portions 50 and 56 is a center partition 58. In the embodiment shown, the various side wall portions are triangular in shape, as can be most clearly seen in FIG. 7; however, this particular configuration is not essential, and for particular applications some or all of the side wall portions may be changed in shape or eliminated. Cover 28 is used to enclose the just previously described apparatus and consists essentially of a top, a bottom, side wall portions and a front portion.

The operating or raising mechanism 30 consists of a notification arm having a vertical shaft portion 70 and a cross member 72 which extends over the top of mailbox 10. Suspended from the cross member 72 is the notification banner 34, and in this particular embodiment, three panels 76, 78 and 80 covered in a brilliant orange paint are used for a banner. In the elevated position, panels 76, 78 and 80 are clearly visible for long distances; yet, being attached by small loops of wire or string 81, the panels fold substantially flat when the arm is in the lowered position, thereby not causing any confusion between the predelivery and postdelivery positions. This is clearly seen by comparing FIGS. 2 and 3, wherein FIG. 2 is the predelivery position and FIG. 3 is the postdelivery position of the arm and panels. A flag or other banner of flexible material which will fold flat in the lowered position is also suitable for a banner. The banner should be covered with a brilliant or fluorescent coating or be of a bright colored material which can readily be visible over substantial distances. The bottom of banner 34 is attached by string or wire 81 to a bracket 82 mounted on the top of the mailbox by a screw or bolt 84. By securing the bottom of banner 34 to bracket 82, the banner will be held relatively stable in the raised position so that wind will not substantially move the banner in a manner which might create confusion with respect to its raised or lowered position, i.e. the wind cannot blow the banner suspended from cross member 72 to a position wherein it is parallel with the top of the mailbox and could not easily be seen.

Vertical shaft portion 70 extends through an opening 85 in the top of cover 28 and downwardly through the top portion 42, the center partition 58 and the bottom portion 44 of the indicator as well as through the bottom of cover 28. A collar 86 is disposed on shaft portion 70 and a compression spring 88 is also disposed on shaft portion 70 between partition 58 and collar 86. A pin 90 through shaft 70 prevents movement of collar 86 above the position of the pin, hence causing spring 88 to react between collar 86 and partition 58. Thus, when released, shaft 70 will be raised and held in its raised position by spring 88 as it urges collar 86 upwardly toward top 42.

Figure 6:
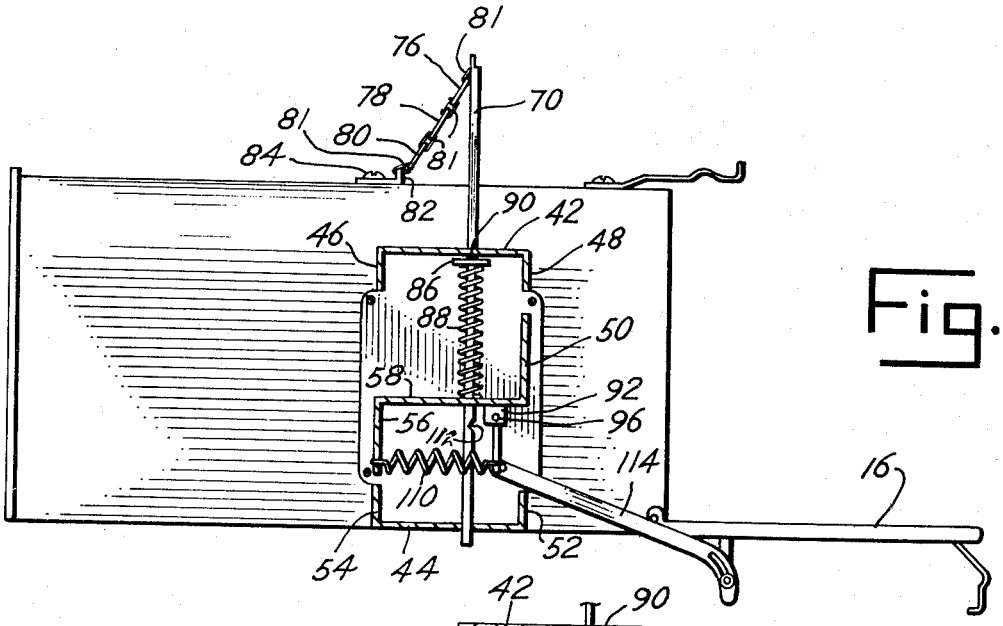
FIG. 6 is a vertical cross sectional view of the mail delivery indicator, taken on line 6—6 of FIG. 3.

Vertical shaft 70 is held in its set position and released to its raised position by trigger or activating mechanism 32, consisting of members 92 and 94 extending downwardly from and integrally attached to partition 58, each having holes therein through which a shaft or pin 96 is disposed. Attached to pin 96 is a plate or arm 98 which has a shaft 100 attached at its lower end. A spring 110 is disposed between side wall portion 56 and plate 98. Spring 110 is a tension type spring which urges plate 98 toward vertical shaft 70, and a notch 112 is disposed in vertical shaft 70, and the lower edge of plate 98 seats in the notch to hold shaft 70 in its lowered position. An operating arm 114 is attached to shaft 100 and extends outwardly toward the front end of the mailbox through opening 115 in cover 28, and is secured to door 16 by a bolt 116 which passes through arm 114 and a bracket 118 which is secured to door 116 by mounting screws or bolts 120 and 122. The attachment of arm 114 to door 16 is such that when door 16 is opened, the movement of the door downward, as shown in FIG. 6, moves arm 114 downwardly, thus dislodging plate 98 from notch 112, thereby allowing compression spring 88 to expand, raising shaft 70 and raising banner 34 to make the banner clearly visible. When door 16 is in the closed position, spring 110 holds plate 98 against shaft 70. If shaft 70 is then lowered, when notch 112 registers with plate 98, spring 110 will hold plate 98 in notch 112, thus retaining shaft 70 in its lowered position.

In the use and operation of the mail delivery indicator embodying the present invention, mounting plate 26 is secured on the side of the mailbox, and arm 114 is attached by bracket 118 to door 16 of the box. When a person retrieves his mail from the mailbox and closes door 16, to activate the notification device to indicate delivery on the following day, all that the person needs to do is to exert conwward pressure on horizontal cross member 72 of the indicator, thus lowering vertical shaft 70. Since spring 110 constantly urges plate 98 toward shaft 70, when notch 112 registers with plate 98, the spring will hold plate 98 in notch 112. A series of notches closely positioned may be provided on shaft 70 so that a quick downward movement of shaft 70 will cause an immediate registry of a notch with plate 98, thereby locking the mechanism in the activated position. At this stage of activation, spring 88 is in a compressed position and is exerting pressure on partition 58 and collar 86. The device is now set to be triggered the following day when the mail carrier delivers the mail.

When delivery is made, as the carrier opens door 16, arm 114 is tilted downward, thereby dislodging plate 98 from notch 112. Compressed spring 88 will automatically move shaft 70 upward by the force exerted on collar 86. This will raise banner 34 from its folded position, thereby indicating that the door has been opened and that delivery of mail has occurred. Since the banner is of a readily visible material, either covered in fluorescent material or painted with fluorescent paint, it will be readily visible for long distances from the mailbox. Hence, the resident will be able to clearly determine whether a trip to the mailbox is required, either from his house or from an intermediate position, without going to the mailbox. Unnecessary trips in inclement weather will not be required, and busy streets or highways will have to be crossed only when there is mail in the box. Only one trip a day will be needed if mail is delivered and, if there is no mail delivered, the resident need not make a trip to the mailbox to determine whether there has been a delivery.

It can be seen that the indicator of the present invention is not hazardous to a person opening the mailbox, as the indicator, vertical shaft portion and banner, which will rise when the door is opened, are located rearwardly from the front of the box. Anyone opening the mailbox, even if positioned close thereto, will not be likely to be near any moving parts of the device which could injure the person. By varying the length of activation arm 114, the indicator can be positioned anywhere along the side or at the rear of the mailbox. The device is easily reset with one hand by pushing downward on shaft portion 70 after door 16 has been closed. Thus, when retrieving the mail, the resident can hold his mail in one hand and reset the device with his free hand. This provides particular advantages over those devices which require a two-handed operation to activate.

Although one embodiment of the present invention has been described in detail herein, various changes and modifications may be made without departing from the scope of the present invention.

I claim:

1. A mail delivery indicator to be attached to a motor carrier delivery mailbox to indicate when mail has been delivered, said indicator comprising a mounting element to be attached to the mailbox, an upper and a lower plate attached to said mounting element, a vertical shaft extending through openings in said upper and lower plates, a notification banner connected to said shaft and having a cross member connected to said vertical shaft and extending over the top of the mailbox and having a plurality of panels suspended from said cross member, foldable substantially flat when said cross member is lowered, a bracket adapted to be attached to the top of the mailbox and connected to the bottom of said banner, a raising means for lifting said banner including a collar disposed on said vertical shaft between said upper and lower plates, a spring reacting between said collar and one of said plates for raising said vertical shaft, and an activation means for activating said raising means in which said activation means automatically triggers said raising means, thereby elevating and displaying said notification banner when the door of the mailbox is opened, said activation means including a notch in said vertical shaft, an activation arm adapted to be connected to the door of the mailbox, and a releasing means operated by said arm for lodging in said notch to hold said vertical shaft in a lowered position.

2. A mail delivery indicator as defined in claim 1 in which said releasing means consists of a shaft journaled in said activation arm, a plate being integral with said shaft and having an edge for lodging in said notch, and a second shaft pivotally suspending said plate from said lower plate.

3. A mail delivery indicator as defined in claim 1 in which a spring is disposed between said releasing means and said lower plate to assist in holding said releasing means in said notch when the door of the mailbox is closed.

4. A mail delivery indicator as defined in claim 2 in which a spring is disposed between said plate of said releasing means and said lower plate to assist in holding said plate of said extension in said notch when the door of the mailbox is closed.

5. A mail delivery indicator as defined in claim 1 in which a bracket is adapted to be attached to the door of the mailbox, and a pin secures said activation arm to said bracket.

6. A mail delivery indicator as defined in claim 1 in which a cover encloses said mounting element, said upper and lower plates, and said raising means.

* * * * *